US010926289B2

(12) United States Patent
Kawakami et al.

(10) Patent No.: US 10,926,289 B2
(45) **Date of Patent: *Feb. 23, 2021**

(54) LAYER-BY-LAYER COATING APPARATUS AND METHOD

(71) Applicant: 3M INNOVATIVE PROPERTIES COMPANY, St. Paul, MN (US)

(72) Inventors: Ellison G. Kawakami, St. Paul, MN (US); William Blake Kolb, Stillwater, MN (US); Henrik B. Van Lengerich, Minneapolis, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 155 days.

This patent is subject to a terminal disclaimer.

(21) Appl. No.: 15/765,869

(22) PCT Filed: Oct. 6, 2016

(86) PCT No.: PCT/US2016/055639

§ 371 (c)(1),
(2) Date: Apr. 4, 2018

(87) PCT Pub. No.: WO2017/066066

PCT Pub. Date: Apr. 20, 2017

(65) Prior Publication Data

US 2018/0281015 A1 Oct. 4, 2018

Related U.S. Application Data

(60) Provisional application No. 62/240,041, filed on Oct. 12, 2015.

(51) Int. Cl.
*B05C 11/06* (2006.01)
*B05C 5/02* (2006.01)
(Continued)

(52) U.S. Cl.
CPC ..... *B05D 1/36* (2013.01); *B05B 1/14* (2013.01); *B05B 7/061* (2013.01); *B05C 5/0245* (2013.01);
(Continued)

(58) Field of Classification Search
USPC ..... 118/313–315, 325, 62, 63, 106
See application file for complete search history.

(56) References Cited

U.S. PATENT DOCUMENTS 3,320,086 A * 5/1967 Rose ..... B05C 9/04 427/211
4,999,927 A * 3/1991 Durst ..... F26B 13/10 34/448

(Continued)

FOREIGN PATENT DOCUMENTS

JP H01-180278 A2 7/1989
WO WO 2008-030474 3/2008
WO WO 2017-066151 4/2017

OTHER PUBLICATIONS

Izquierdo, "Dipping versus Spraying: Exploring the Deposition Conditions for Speeding Up Layer-by-Layer Assembly", Langmuir, 2005, vol. 21, No. 16, pp. 7558-7567.

(Continued)

*Primary Examiner* — Yewebdar T Tadesse
(74) *Attorney, Agent, or Firm* — Yufeng Dong

(57) ABSTRACT

Apparatus and method useful for, among other things, providing a layer by layer coating of materials on a substrate.

8 Claims, 2 Drawing Sheets

(51) Int. Cl.

| | |
|---|---|
| ***B05B 7/06*** | (2006.01) |
| ***B05D 1/36*** | (2006.01) |
| ***B05D 3/04*** | (2006.01) |
| ***B05D 7/00*** | (2006.01) |
| ***B05D 1/02*** | (2006.01) |
| ***B05B 1/14*** | (2006.01) |

(52) U.S. Cl.
CPC ..... *B05C 11/06* (2013.01); *B05D 1/02* (2013.01); *B05D 3/042* (2013.01); *B05D 7/54* (2013.01); *B05D 3/0466* (2013.01)

(56) References Cited

U.S. PATENT DOCUMENTS

| | | | | |
|---|---|---|---|---|
| 7,645,355 | B2 | 1/2010 | Bilski | |
| 7,707,963 | B2 | 5/2010 | Ciliske | |
| 8,234,998 | B2 | 8/2012 | Krogman | |
| 8,585,826 | B2 | 11/2013 | Schreiber | |
| 8,794,175 | B2 | 8/2014 | Kotov | |
| 2002/0089079 | A1* | 7/2002 | Shelley | D01D 5/22 264/103 |
| 2004/0157047 | A1 | 8/2004 | Mehrabi | |
| 2007/0032869 | A1 | 2/2007 | Gilliard | |
| 2014/0079884 | A1 | 3/2014 | Krogman | |
| 2016/0282046 | A1* | 9/2016 | Schromm | F26B 21/004 |

OTHER PUBLICATIONS

Schlenoff, "Sprayed Polyelectrolyte Multilayers", Langmuir, 2000, vol. 16, No. 26, pp. 9968-9969.

Seyrek, "Layer-by-Layer Assembly of Multifunctional Hybrid Materials and Nanoscale Devices", Polymer Science: A Comprehensive Reference, 2012, vol. 7, pp. 159-185.

Shim, "Nanostructured Thin Films Made by Dewetting Method of Layer-By-Layer Assembly", Nano Letters, 2007, vol. 7, No. 11, pp. 3266-3273.

International Search Report for PCT International Application No. PCT/US2016/055639, dated Dec. 21, 2016, 4 pages.

* cited by examiner

LAYER-BY-LAYER COATING APPARATUS AND METHOD

CROSS REFERENCE TO RELATED APPLICATIONS

This application is a national stage filing under 35 U.S.C. 371 of PCT/US2016/055639, filed Oct. 6, 2016, which claims the benefit of U.S. Patent Application No. 62/240,041, filed Oct. 12, 2015, the disclosure of which is incorporated by reference in its/their entirety herein.

TECHNICAL FIELD

The disclosure relates to an apparatus for layer-by-layer coating as well as methods of layer-by-layer coating.

BACKGROUND

Layer-by-layer (sometimes known as LBL) coating is known in the art, and was traditionally performed by a dip-coating technique wherein a substrate was dipped in a polycation solution to deposit a monolayer of polycation. The substrate was removed from the polycation solution, rinsed to remove excess polycation, dipped into a polyanion solution to deposit a monolayer of polyanion, removed from the polyanion solution, and finally rinsed again to remove excess polyanion. The result of that process was a bilayer deposited on a surface of the substrate. The process could be repeated to obtain the desired number of bilayers.

A variety of substances have been used for the various monolayers of the LBL bilayer. Typically, the two monolayers are chosen so that each of the monolayers binds or adheres only to the other monolayer (and, in the case of the first deposited monolayer, to the substrate) but not to itself.

SUMMARY

An apparatus can comprise a first roller for moving a belt and a second roller for moving a belt. The apparatus can include a belt having a first major surface and a second major surface tensioned around the first roller and the second roller. A first deposition station can be positioned to face belt, the first deposition station comprising a first self-limiting monolayer forming material depositing element for affixing a monolayer of a first self-limiting monolayer forming material to the belt. A first directional gas curtain producing element can be positioned downstream from the first deposition station.

A second deposition station that is different from the first deposition station can optionally be employed in which case it can be positioned to face the outside surface of the belt, the second deposition station comprising a second self-limiting monolayer forming material depositing element for affixing a monolayer of a second self-limiting monolayer forming material to the belt. The second deposition can be downstream of the first deposition station and downstream from the first directional gas curtain producing element. A second directional gas curtain producing element can be positioned downstream from the second deposition station to face the outside of the surface of the belt to provide a gas curtain blowing on the outside surface of the belt.

DETAILED DESCRIPTION

Figure 1:
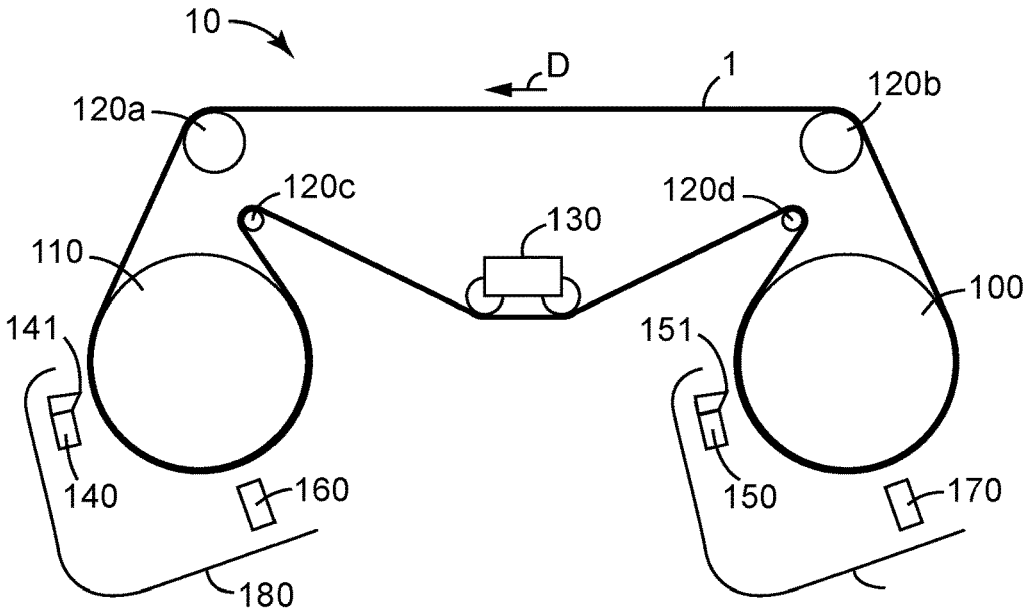
FIG. 1 is a schematic of an apparatus as described herein.

Throughout this disclosure, singular forms such as "a," "an," and "the" are often used for convenience; however, it should be understood that the singular forms are meant to include the plural unless the singular alone is explicitly specified or is clearly indicated by the context.

An apparatus can include a first and second roller for moving a belt. The first and second rollers can be made of any suitable material. Suitable materials include metal, ceramic, plastic, and rubber, including another material covered in rubber. The rollers can be of any suitable size. The width of the rollers will depend on the width of the belt that is to be used. In most cases, the rollers will be the same width or slightly wider than the belt. The diameter of the rollers will depend on factors such as on the available space for the device. While no particular diameter is required, some suitable rollers can have a diameter of, for example, 5 cm to 50 cm; some exemplary rollers used by the inventors have a diameter of 25.4 cm.

One or more additional rollers can be employed to direct the belt along a particular route. Other elements, such as one or more steering units can also be used for this purpose.

The belt can be the substrate on which the various layers are deposited. The belt can be any substance that can be used as a substrate for LBL deposition. Exemplary substrates include polymers, fabric, paper, or a transfer adhesive film, such as a transfer adhesive film containing microspheres. Polymers that can be used include polyester, such as polyethylene terephthalate, particularly as available under the trade designation MELINEX from E. I. DuPont de Neumours and Co. (Wilmington, Del., USA) polycarbonate, polyvinylchloride, polyvinylidenechloride, sulfonated polyester, acrylics, such as polymers or copolymers of acrylic acid, acrylic acid esters, methacrylic acid, methacrylic acid esters, and the like, and polyurethanes. Fabrics can include medical fabrics, textiles, and the like. Papers can include any sort of cellulose or cellulosic-based film. A transfer adhesive film can be used. Suitable transfer adhesive films are known in the art, and can be made, for example according to the methods described in U.S. Pat. No. 7,645,355.

A belt often has a first major surface and a second major surface. The major surfaces are the two surfaces having the greater width and surface area. The first major surface is typically on the opposite side of the second major surfaces. A belt can also have two other surfaces representing the height of the belt; these surfaces can be referred to as the first and second minor surfaces.

The belt can be an endless belt. In such cases, the belt is a loop with no beginning and no end. Alternatively, the belt can have a distinct beginning and a distinct end.

The belt can be positioned such that, for at least a portion of the path of the belt, typically including the portion of the path where the belt is opposite the deposition station or stations, the first and second major surfaces of the belt are substantially normal to gravity, that is, such that the first and second major surfaces are substantially parallel to ground.

This positioning can be useful to allow a deposited layer to have a uniform or nearly uniform thickness across the entire width of the first or second major surface of the belt. Thus, substantially normal to gravity or substantially parallel to the ground allows for some tilt, typically not more than 5°, in either direction.

The first or second major surface of the belt can be suitable for bonding, adsorbing, or coating with a first self-limiting monolayer forming material. If the surface is not suitable for this purpose, it can be treated by any appropriate method to render it suitable. Typically, such surface modification is by way of plasma or corona treatment to make the surface more hydrophilic. A variety of plasma treatment methods are known, and any suitable method can be used. One suitable method of plasma treatment is described in U.S. Pat. No. 7,707,963. One suitable treated film is commercially available under the trade designation SKYROL from SKC, Inc (Covington, Ga., USA).

The first deposition station, which comprises a first self-limiting monolayer forming material, is typically positioned to face a first major surface of the belt. Thus, the first deposition station is designed to affix at least one monolayer of a first self-limiting monolayer forming material to the belt. In order to face the first major surface of the belt, it is not necessary that the entirety of the first deposition station be positioned at or near the first major surface of the belt, so long as the first deposition station is positioned such that the first self-limiting monolayer forming material is applied to and affixed to the first major surface of the belt. Thus, when the first deposition station comprises a sprayer for affixing the first self-limiting monolayer forming material to the belt, the sprayer can be positioned to spray onto first major surface of the belt whereas other components of the first deposition station, which can include, for example, one or more hoses, valves, and containers for storing or transporting the first self-limiting monolayer forming material, can be positioned in one or more other locations.

The first deposition station can comprise, for example by including a container or applicator that contains, a first self-limiting monolayer forming material depositing element for depositing the first self-limiting monolayer forming material. Any element suitable for depositing the first self-limiting monolayer forming material can be used, depending on the nature of the first self-limiting monolayer forming material, the presence or absence of solvent, the nature of the solvent if solvent is used, the deposition rate, and the like. Suitable first self-limiting monolayer forming material depositing elements include rod coaters, knife coaters, air knife coaters, blade coaters, roll coaters, slot coaters, slide coaters, curtain coaters, gravure coaters, and sprayers. Most commonly, one or more sprayers are used.

The first self-limiting monolayer forming material is often a component of a first liquid. In this case, first liquid typically includes one or more liquid components as well as the first self-limiting monolayer forming material. The first self-limiting monolayer forming material can be dissolved or dispersed in the one or more liquid components. The one or more liquid components can be any suitable liquids for dissolving or dispersing the first self-limiting monolayer forming material. As such, the identity of the one or more liquid components will depend on the nature of the first self-limiting monolayer forming material. Suitable liquid components can include one or more of water, such as buffered water, and organic solvents, such as benzene toluene, xylenes, ethers, such as diethyl ether, ethyl acrylate, butyl acrylate, acetone, methyl ethyl ketone, dimethylsulfoxide, dichloromethane, chloroform, turpentine, hexanes, and the like.

When used, the second deposition station, which comprises a second self-limiting monolayer forming material, is typically positioned to face a major surface the belt. Typically, the second deposition station will face the first major surface of the belt to deposit at least a monolayer of a second self-limiting monolayer forming material to the belt over the first self-limiting monolayer-forming material. To accomplish this, it is not necessary that the entirety of the second deposition station be positioned at or near the first major surface the belt, so long as the second deposition station is positioned such that the second self-limiting monolayer is applied to and affixed to the first major surface of the belt. Thus, when the second deposition station comprises a sprayer for affixing the second self-limiting monolayer forming material to the belt, the sprayer can be positioned to spray onto the first major surface of the belt whereas other components of the second deposition station, which can include, for example, one or more hoses, valves, and containers for storing and transporting the second self-limiting monolayer forming material, can be positioned in another location. While less common, it is also possible for the second deposition station to face the second major surface of the belt, such that it affixes the second self-limiting monolayer-forming material to the second major surface rather than the first major surface. In this case, the second deposition station will deposit the second self-limiting monolayer forming material on the opposite side of the belt from the first self-limiting monolayer forming material.

The second deposition station can comprise, for example by including a container or applicator that contains, a second self-limiting monolayer forming material depositing element for depositing the second self-limiting monolayer forming material. Any element suitable for depositing the second self-limiting monolayer forming material can be used, depending on the nature of the second self-limiting monolayer forming material, the presence or absence of solvent, the nature of the solvent if solvent is used, the deposition rate, and the like. Suitable second self-limiting monolayer forming material depositing elements include rod coaters, knife coaters, air knife coaters, blade coaters, roll coaters, slot coaters, slide coaters, curtain coaters, gravure coaters, and sprayers. Most commonly, one or more sprayers are used.

A second self-limiting monolayer forming material is typically present within the second deposition station. The second self-limiting monolayer forming material can be a component of a second liquid. The second liquid can comprise the second self-limiting monolayer forming material as well one or more of the liquid components discussed above with respect to the first liquid.

A third, fourth, and even further deposition stations can also be used in addition to the first and second deposition stations. These third, fourth, or further deposition stations can have essentially the same characteristics and configuration as the first and second deposition stations described herein, and can include a third, fourth, or further self-limiting monolayer forming material as well as a third, fourth, or further liquid. In some configurations, the apparatus can have no fewer than 2, 5, 10, 20, 30, 40, 50, 60, 70, 80, 90, 100, 150, or 200 deposition stations.

The self-limiting monolayer forming materials, such as the first and second self-limiting monolayer forming materials can be any materials that are, when applied consecutively, suitable for forming bilayers on the belt. Typically, first and second self-limiting monolayer forming materials are complementary, and are chosen such that the first self-limiting monolayer forming material does not bind to itself, but instead binds to the second self-limiting monolayer forming material and, in some cases, the belt. Complementary materials that are suitable for the first and second self-limiting monolayer forming materials are known to the artisan, and have been disclosed, for example, in *Polymer Science: A Comprehensive Reference, Volume* 7 section 7.09 (Seyrek and Decher). Exemplary materials include those that interact by electrostatic interactions, those that interact by hydrogen bonding, those that interact by base-pair interactions, those that interact by charge transfer interactions, those that interact by stereocomplexation, and those that interact by host-guest interaction.

Exemplary materials that can interact by electrostatic interaction to form LbL layers include cationic materials and anionic materials, for example, polycations and polyanions, cationic particles (which can be nanoparticles) and anionic particles (which can be nanoparticles), polycations and anionic particles (which can be nanoparticles), cationic particles (which can be nanoparticles) and polyanions, etc. Exemplary polycations include poly(allylamine hydrochloride), polydiallyldimethylammonium chloride, and polyethyleneimine. Exemplary polyanions include poly(sodium 4-styrene sulfonate), poly(acrylic acid), poly(vinyl sulfonate). Natural polyelectrolytes, such as heparin, hyaluronic acid, chitosan, humic acid, and the like, can also be used as polycations or polyanions. Particles with charged surfaces can include silica (which can have a positively or negatively charged surface depending on how the surface is modified), metals, latex, and charged protein particles.

Exemplary materials that can interact by hydrogen bonding to form LbL layers include polyaniline, polyvinylpyrrolidone, polyacrylamide, poly(vinyl alcohol), and poly(ethylene oxide). Also, particles, such as gold nanoparticles and CdSe quantum dots, can be modified with hydrogen bonding surface groups for use in LbL deposition. Typically, one hydrogen bond donor material, having a hydrogen atom bound to an oxygen or nitrogen atom, and one hydrogen bond acceptor material, having an oxygen, fluorine, or nitrogen atom with a free electron pair, are chosen as complementary materials.

Base pair interactions can form LbL layers based on, for example, the same types of base pairings that in natural or synthetic DNA or RNA.

Charge transfer interactions can form LbL bilayers wherein one layer has electron donating groups and the other has electron accepting groups. Examples of electron acceptors that can be used include, poly(maleic anhydride), poly (hexanyl viologen), carbon nanotubes, and dinitrobenxyl silsequioxane. Examples of electron donors that can be used include carbazolyl containing polymers, such as poly(carbazole styrene), organic amines, pi-conjugated poly(dithiafulvalene), and polyethylene imine.

Stereocomplexation can be used to form LbL layers between materials with well defined and complementary stereochemistry, such as isotactic and syndiotactic poly (methyl methacrylate) as well as enantiomeric L- and D-polylactides.

Host guest interactions can be used to form LbL layers when a suitable host material layer is deposited on a suitable guest layer, or vice versa. Biotin and streptavidin is one host-guest pair that can be used to form LbL bilayers. Enzymes or antibodies can also be paired with their substrates to form LbL bilayers. Examples include glucose oxidase and glucose oxidase anitbodies, maleimide and serum albumin.

When a third, fourth, or further deposition stations are used, then additional self-limiting monolayer forming materials (beyond the first and second self-limiting monolayer forming materials) can also be used. In this case, the various deposition elements are positioned so that alternating layers of complementary self-limiting monolayer forming materials are deposited on the belt. For example, if four deposition stations are used, the first deposition station can deposit cationic polydiallyldimethylammonium chloride, the second deposition station can be downstream from the first deposition station and can deposit anionic poly(acrylic acid), and third deposition station can be downstream from the second deposition station and deposit cationically surface modified silica particles, and the fourth deposition station can be downstream from the third deposition station and upstream from the first deposition station, and can deposit anionic (that is, partially deprotonated) hyalauronic acid as a fourth self-limiting monolayer forming material.

Directional gas curtain producing elements, which are sometimes known as air knives, are known in the art and are commercially available, for example under the trade designation SUPER AIR KNIFE (EXAIR Corp., OH, USA). Such devices produce a narrow stream of forced air moving at high velocity. The stream of forced air typically has a width equal to or greater than the width of the belt, such that the entire width of the belt is engaged by the gas curtain and subjected to the forced air.

In an apparatus as described herein, a first directional gas curtain producing element can be positioned downstream from the first deposition station and, when a second deposition station is employed, upstream from the second deposition station. The first directional gas curtain producing element typically faces the same surface of the belt as the first deposition station and, in use, provides a gas curtain blowing on the outside surface of the belt. The gas curtain is typically blown at high pressure so as to simultaneously meter (that is, physically remove or slough off) excess first self-forming monolayer material from the belt and dry (that is, encouraging or effecting evaporation) any first liquid that contains the first self-limiting monolayer forming material. The directional gas curtain producing element is typically positioned so as to be perpendicular or nearly perpendicular to the belt.

The directional gas curtain producing elements in any of the apparatuses or methods described herein can be positioned to direct a gas curtain at a desirable angle with respect to the belt. The angle is typically no less than 80°, or more particularly no less than 85°. The angle is most commonly 90°. When the angle is less than 90°, the directional gas curtain producing element is most often positioned so that the air is blown upstream, that is, towards the preceding depositing element.

The first directional gas curtain producing element in any of the apparatuses or methods described herein can be positioned at an appropriate distance to the belt. The distance between the gas outlet on a directional gas curtain producing element and the belt is sometimes known as the gap. If the gap is too large, then the web may not be sufficiently dry. The gap is typically no more than 0.8 mm, such as no more than 0.75 mm, no more than 0.7 mm, no more than 0.65 mm, no more than 0.6 mm, no more than 0.55 mm, or no more than 0.5 mm.

The flux of gas, which is typically air, through the first directional gas curtain producing element is another parameter than can affect the dryness of the belt. The flux of gas is typically measured as flux per length of the gas curtain ("flux per length"); this value has units of $m^2/s$. When the flux per length is too low, then the gas curtain may not be effective at metering and drying liquid on the belt. Typical flux per length (in $m^2/s$) are no less than 0.02, no less than 0.02, no less than 0.024, no less than 0.025. no less than 0.026, no less than 0.028, or no less than 0.03.

A second directional gas curtain producing element can be positioned downstream from the second deposition station. If a third deposition station is employed, the second directional gas curtain producing element can be upstream from the third deposition station. The second directional gas producing element typically has the same characteristics described above with respect to the first directional gas producing element.

If third, fourth, or even further deposition stations are used, each will typically have an associated directional gas curtain producing element located downstream from the associated deposition station and upstream from any subsequent deposition station.

The apparatus can also include a first backing element positioned such that at least a portion of the belt is interposed between the first backing element and the first directional gas curtain producing element. This first backing element can be useful for preventing the gas curtain produced by the first directional gas curtain producing element from disrupting other parts of the apparatus, for example, from blowing on another portion of the belt, as well as preventing the portion of the first self-limiting monolayer and, if used, the first liquid, that are metered off the belt from blowing onto another portion of the apparatus or on another portion of the belt. The first backing element can be made of any suitable material, but is typically plastic, metal, or ceramic. It can be coated with a suitable coating, such as a non-stick coating.

The apparatus can further include a second backing element positioned such that at least a portion of the belt is interposed between the second backing element and the second directional gas curtain producing element. The second backing element, when present, can serve the same purpose as the first backing element, and can be made of the same materials.

When third, fourth, or further deposition stations are employed, corresponding third, fourth, or further backing elements can be used. Each backing element can correspond to a particular deposition station, such that a portion of the belt passes between a deposition station and its corresponding backing element. Two or more of the backing elements can be integrated, that is, they can be different parts of a single element. Such integration is not required.

Backing elements are not required. Also, it is possible that some deposition stations can have corresponding backing elements while others have no backing elements. This is often the case when a deposition station is positioned such that a portion of the belt is disposed between the deposition station and a roller. However, even when the belt is not disposed in that manner, the backing element may not be necessary.

The apparatus, in most cases, does not include any rinsing element. A rinsing element is an element that applies a liquid to the belt in order to rinse unbound materials, which are typically excess materials such as over-spray, off the belt. Such apparatus is not required in the present apparatus because the first and second directional gas curtain producing elements meter unbound materials off the belt. Thus, the function of the rinsing elements found in the prior art is retained while the rinsing elements themselves are omitted.

The apparatus can also include a first recycling element. The first recycling element can recover at least a portion of any excess first self-limiting monolayer forming material, and, if used, first liquid, and return those materials to the first deposition for re-use. Excess first self-limiting monolayer forming material, and, if used, excess first liquid, includes both over-applied, such as oversprayed, first self-limiting monolayer forming material, and, if used, oversprayed first liquid, as well as first self-limiting monolayer forming material, and, if used, first liquid, that is metered from the belt by the first directional gas-curtain producing element. The first recycling element can include a container, such as a tank, for catching such excess and a transport element, such as a hose and pump, for returning the excess to the first deposition station. The container can be placed between the first deposition station and the first directional gas curtain producing element in order to effectively collect at least some of the excess first self-limiting monolayer forming material, and, if used, excess first liquid. In practice, the amount of excess first self-limiting monolayer forming material or first liquid that can be collected can be at least 50%, at least 55%, at least 60%, at least 65%, at least 70%, at least 75%, at least 80%, at least 85%, at least 90%, at least 95%, or at least 99% of the total amount of excess first self-limiting monolayer forming material or first liquid that is not bound to the belt. In practice, when a sprayer is used in the first deposition station, 90% of the excess or oversprayed first liquid can be recovered.

A second recycling element can also be employed. The second recycling element can have essentially the same features as the first recycling element, described above, and can recover the second self-limiting monolayer forming material or the second liquid. The second recycling element can be positioned between the second deposition station and the second directional gas curtain producing element to most effectively recover any excess.

When more than two deposition stations are employed, additional recycling elements can also be used so that each deposition station can have a corresponding recycling element.

As discussed above, rinsing elements are typically omitted from the apparatus described herein. If present, rinsing elements would dilute the self-limiting monolayer forming materials, thereby changing their concentration. As such, the lack of one or more rinsing elements facilitates the use of recycling elements to recycle those materials. It is possible for an apparatus to contain both a rinsing element and a recycling element provided that the rinsing element does not dilute the material to be recycled. For example, if only the first self-limiting monolayer forming material is to be recycled, a rinsing element for rinsing excess second self-limiting monolayer forming material can be employed.

In use, the apparatus as described herein can affix a monolayer of the first self-limiting monolayer forming material or a monolayer of the second self-limiting monolayer forming material to the belt while the belt is moving at a suitable speed. Any speed can be used so long as the monolayer is deposited on the belt. Suitable speeds can be, for example, at least 0.25 m/s, at least 0.50 m/s, at least 0.75 m/s, at least 1 m/s, at least 1.25 m/s, or at least 1.5 m/s.

An apparatus, such as that described above, can be used in a method of making a layer-by-layer coating on a substrate. The method can comprise tensioning a substrate in the form of a belt around a first roller and a second roller. Subsequently, a first deposition station that is positioned to face the outside surface of the belt, the first deposition station comprising a first self-limiting monolayer forming material depositing element, can be engaged to affix a monolayer of a first self-limiting monolayer forming material to the belt. A second deposition station that is positioned to face the outside surface of the belt, the second deposition station comprising a second self-limiting monolayer forming material depositing element, can be engaged to affix a monolayer of a second self-limiting monolayer forming material to the belt. The second deposition station can be downstream of the first deposition station. Further deposition stations and corresponding directional gas curtain producing elements can also be used.

The first self-limiting monolayer forming material and the second self-limiting monolayer forming material are often selected to be complementary. Thus, the first self-limiting monolayer forming material can be a material that does not bind well to itself, but instead binds well to the second self-limiting monolayer forming material and, in some cases, to the substrate, such that the two self-limiting monolayer forming materials can, after repeated application to the substrate, form one or more bilayers on the substrate.

It is also possible to form only a single layer, for example, a single monolayer, on the belt. In this case, only a first deposition station needs to be employed.

A first directional gas curtain producing element that is positioned downstream from the first deposition station and upstream from the second deposition station can be engaged to provide a gas curtain blowing on the outside surface of the belt. A second directional gas curtain producing element a positioned downstream from the second deposition station can be engaged to provide a gas curtain blowing on the outside surface of the belt.

When third, fourth, or further deposition stations are employed, for example, for affixing additional materials to the belt, each can have a corresponding directional gas curtain producing element that functions generally in the same manner as the first and second directional gas curtain producing elements described herein.

It is possible to change any of the self-limiting monolayer forming materials during operation in order to affix more than two types of materials to the belt without employing a third, fourth, or further deposition station. For example, an apparatus with a first and second deposition station can be arranged such that the first deposition station contains a polyquaternium cation and the second deposition station contains a polystyrene sulfonate anion. After affixing a layer of polyquaternium cation and a layer of polystyrene sulfonate, the polyquaternium can be replaced by another cationic material, such as polytrimethylammoniumethyl methacrylate, and the polycation can be replaced by another anionic material, such as anionic silica nanoparticles. Subsequently a layer of polytrimethylammoniumethyl methacrylate and a layer of anionic silica nanoparticles can be affixed to the belt. The resulting belt will have a layer of polyquaternium, a layer of polystyrene sulfonate, a layer of polytrimethylammoniumethyl methacrylate, and a layer of anionic silica nanoparticles. This procedure is particularly useful when space or other constraints prevent a third, fourth or further deposition station from being employed.

Typically, the use of one or more directional gas curtain producing elements makes a rinsing step unnecessary. This is so because directional gas curtain producing element or elements can remove excess monolayer forming materials and their associated liquids (if any) by metering. Thus, the methods of use typically do not include any step for rinsing excess self-limiting monolayer forming material off of the belt.

Omitting a rinsing element can also facilitate the recycling of excess monolayer forming materials, and, when used, the liquids that contain them. This is so because a rinsing element, if used, would dilute the monolayer forming materials or liquids, thereby changing their concentrations and potentially making them unsuitable for further use after collection. The inventors have shown that even if metering with a directional gas curtain producing element changes the concentration of self-limiting monolayer forming materials, it does not do so to such an extent as to preclude reusing collected excess.

The belt can be moved around the first roller and the second roller to alternatively layer-by-layer deposit on the belt at least one layer of the first self-limiting monolayer forming material, at least one layer the second self-limiting monolayer forming material, or at least one layer of each. When the belt is an endless belt, the belt can revolve around the first roller and the second roller any suitable number of times, wherein each revolution adds a monolayer or a bilayer to the surface. In this type of continuous process, there is often no need for the belt to stop moving until an endpoint is reached. Depending on the ultimate use of the substrate, the desired endpoint can be the deposition of a pre-determined number of monolayers, the passing of a pre-determined deposition time, achieving a pre-determined thickness, or achieving a pre-determined optical, chemical, or physical property of the coating. In some cases, the belt may be stopped before the endpoint is reached, for example, to adjust the apparatus, to move collected excess material from a recycling element to a deposition station, to change the nature of the material being deposited by a deposition station, etc.

The apparatus can also be used in a semi-continuous process, such as a roll-to-roll process. In an example of such a process, a belt with a beginning and an end is unwound from the first roller and wound onto the second roller to pass the deposition station or stations. When the belt is completely unwound, for example, unwound to an extent such that only an end of the belt remains on the first roller, then the belt is rewound from the second roller back onto the first roller. Typically, all of the elements of the deposition station or stations are disengaged during the rewinding step.

When one or more recycling elements, such as the first or second recycling elements, are present, one or more of them can be engaged to recycle the first or second self-limiting monolayer forming materials and, if used, first or second liquids.

Turning to the Figures, which depict schematics of particular embodiments of apparatuses as described herein, FIG. 1 depicts apparatus 10 having belt 1 tensioned around first roller 110 and second roller 100. Additional rollers 120*a*, 120*b*, 120*c*, and 120*d* as well as steering unit 130 are also present to position belt 1 on the desired path and move belt 1 in direction D. First deposition station 140 contains first deposition element 141, which in this example is a spray nozzle. Second deposition station 150 contains second deposition element 151, which in this case is s spray nozzle. First directional gas curtain producing element 160 is located downstream from first deposition station 140 and upstream from second deposition station 150. Second directional gas curtain producing element 170 is located downstream from second deposition station 150 and upstream from first deposition station 140.

First recycling element 180 is positioned to catch excess material that either drips off belt 1 or is metered off belt 1 by the first directional gas curtain producing element 160. Likewise, second recycling element 190 is positioned to catch excess material that either drips off belt 1 or is metered off belt 1 by the second directional gas curtain producing element 170. In this Figure, there is no hose or other mechanical connection between first and second recycling elements 180 and 190 and the respective first and second deposition stations 140 and 150. Instead, the material collected in first and second recycling elements 180 and 190 can be manually returned to first and second deposition stations 140 and 150.

Figure 2:
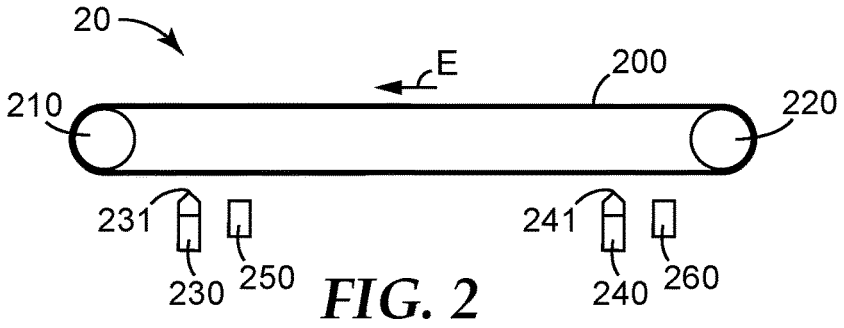
FIG. 2 is a schematic of another apparatus as described herein.

FIG. 2 depicts apparatus 20 having belt 200 tensioned around first roller 210 and second roller 220, which move belt 200 in direction E. First deposition station 230, including first deposition element 231, which is a spray nozzle in this Figure, is positioned upstream of first directional gas curtain producing element 250, which is an air knife in this Figure. Second deposition station 240, including second deposition element 241, which is a spray nozzle in this Figure, is positioned upstream of second directional gas curtain producing element 260.

Figure 3:
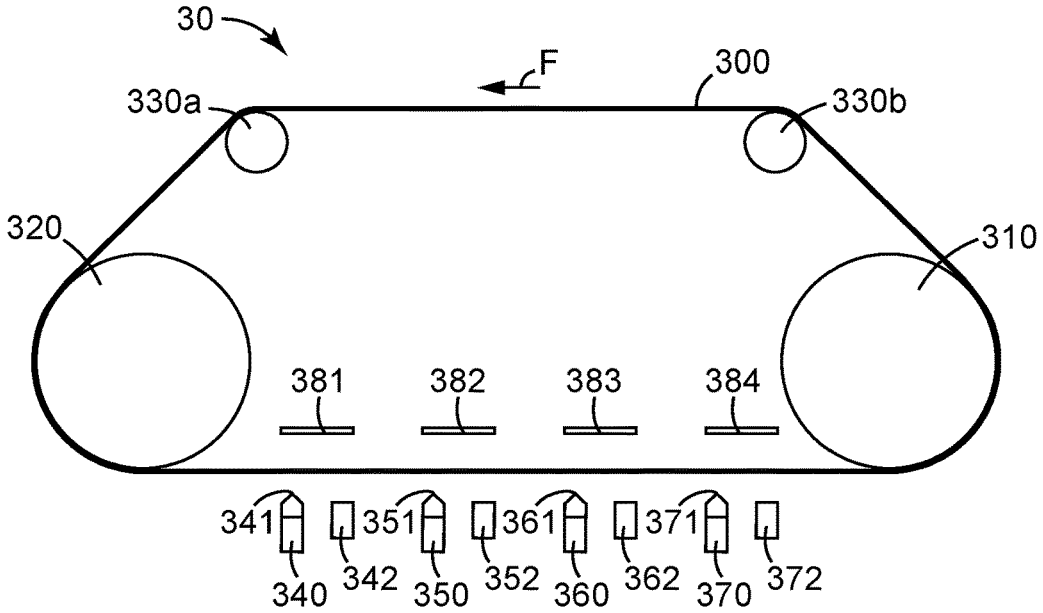
FIG. 3 is a schematic of yet another apparatus as described herein.

FIG. 3 depicts apparatus 30 having belt 300 tensioned around first roller 320 and second roller 310, as well as additional rollers 330*a*, and 330*b* for moving belt 300 in direction F. First deposition station 340 includes first deposition element 341, which is a spray nozzle in this Figure, and is positioned to face the outside surface of belt 300. First backing element 381 is disposed on the opposite side of belt 300 from first deposition station 340, such that a portion of belt 300 is interposed between first backing element 381 and first deposition station 340. First directional gas curtain producing element, 342, which is an air knife in this Figure, is downstream from first deposition station 340. First backing element 381 is positioned such that a portion of belt 300 in interposed between it and first directional gas curtain producing element 340. Second deposition station 350 contains second deposition element 351, which is a spray nozzle in this Figure, and is positioned downstream from first directional gas curtain producing element 352. Second backing element 382 is positioned such that a portion of belt 300 is interposed between it and second deposition station 350. Second directional gas curtain producing element 351, which is an air knife in this Figure, is positioned downstream from second deposition station 350. Second backing element 382 is positioned such that a portion of belt 300 is interposed between it and second deposition station 350. Third deposition station 360 includes third deposition element 361, which is a spray nozzle in this Figure, and is positioned upstream from third directional gas curtain producing element 362. Third backing element 383 is positioned such that a portion of belt 300 is interposed between it and third deposition station 360.

While FIG. 3 depicts the four backing elements as distinct, it is also possible for two or more of these backing elements to be combined into a single element.

Figure 4:
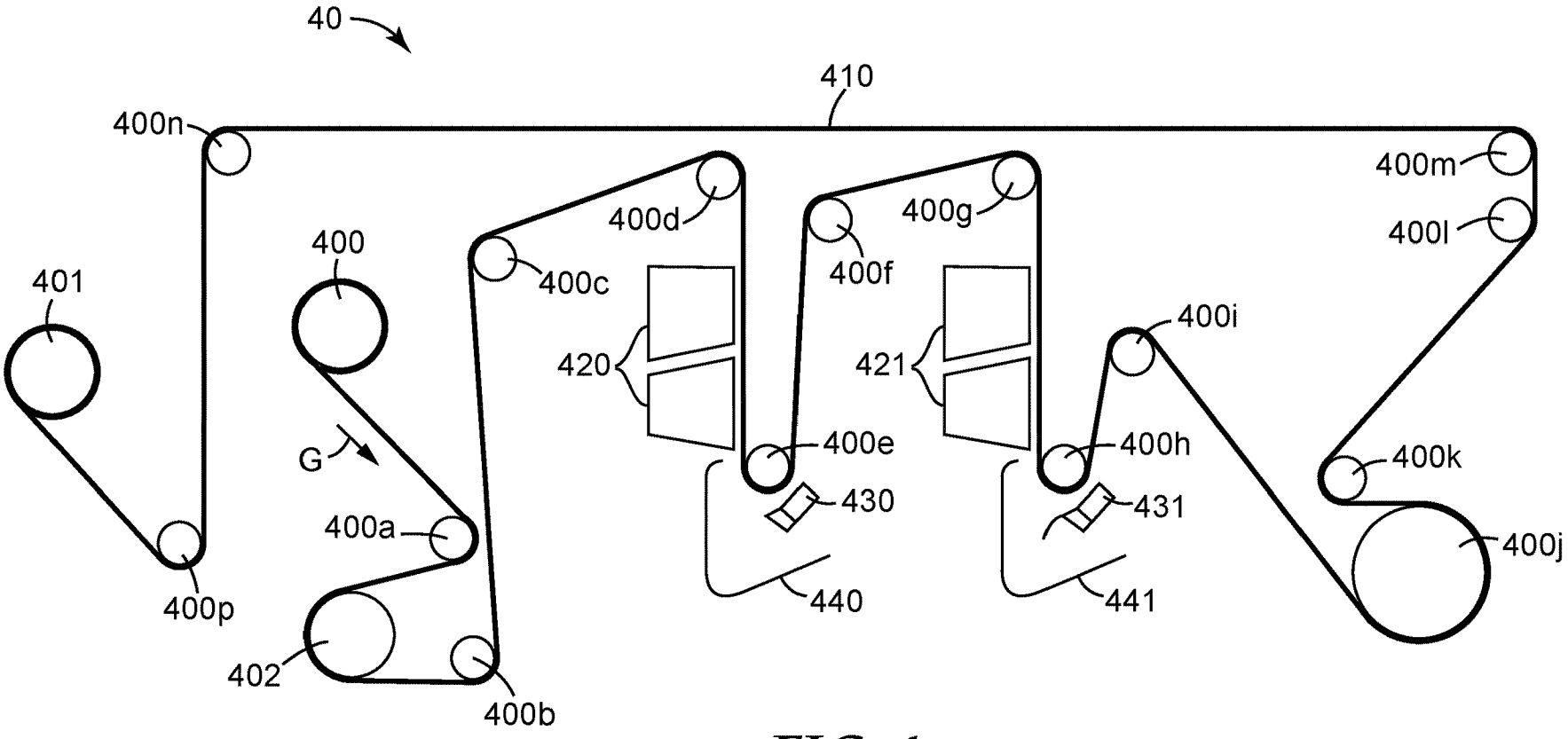
FIG. 4 is a schematic of still another apparatus as described herein.

FIG. 4 depicts apparatus 40, which is particularly useful for performing roll-to-roll processes. Apparatus 40 includes first roller 400 and second roller 401, as well as additional rollers 400*a*, 400*b*, 400*c*, 400*d*, 400*e*, 400*f*, 400*g*, 400*h*, 400*i*, 400*j*, 400*k*, 400*l*, 400*m*, 400*n*, and 400*p*. in addition to tension controller 402. First roller 400 is an unwinding roller. In use, belt 410 is tensioned around the rollers with the majority of belt 410 being wound around first roller 400. Belt 410 is unwound by first roller 400 in direction G. The belt passes first deposition station 420 and first directional gas curtain producing element 430, which are upstream from second deposition station 421 and second directional gas curtain producing element 431. First recycling element 440, which is in the form of a catch pan in this Figure, is positioned to catch liquid that is metered off of belt 410 near first deposition station 420, and second recycling element 441, also in the form of a catch pan in this Figure, is similarly positioned with respect to second deposition station 421. In use, the belt can move from first roller 400 towards the second roller 401 in direction G. Once the belt has been unwound from first roller 400 and had a first and second self limiting monolayer forming material affixed thereto by first and second depositions stations 420 and 421, belt 401 is wound about second roller 401. At this point, second roller 401 and first roller 400 can, if desired, be removed from the apparatus and swapped such that second roller 401 is in the place currently occupied by first roller 400 and vice versa. At this point, the process can be repeated to move belt 401 past first and second deposition stations 420 and 421 a second time.

LIST OF ILLUSTRATIVE EMBODIMENTS

The following embodiments are listed to illustrate particular features of the disclosure, and are not intended to be limiting.

Embodiment 1

An apparatus comprising
- a first roller for moving a belt;
- a second roller for moving a belt;
- a belt having tensioned around the first roller and the second roller;
- a first deposition station positioned to face the belt, the first deposition station comprising a first self-limiting monolayer forming material depositing element for affixing at least a monolayer of a first self-limiting monolayer forming material to the belt, and
- a first directional gas curtain producing element positioned downstream from the first deposition station to provide a gas curtain blowing the belt.

Embodiment 2

The apparatus of embodiment 1, further comprising a second deposition station positioned to face the belt, the second deposition station comprising a second self-limiting monolayer forming material depositing element for affixing at least a monolayer of a second self-limiting monolayer forming material to the belt.

Embodiment 2s

The apparatus of any preceding embodiment comprising no fewer than 2, 5, 10, 20, 30, 40, 50, 60, 70, 80, 90, 100, 150, or 200 deposition stations

Embodiment 3

The apparatus of any preceding embodiment, wherein the first deposition station is configured to affix the first self-limiting monolayer forming material on a first major surface of belt.

Embodiment 4

The apparatus of any preceding embodiment, wherein the second deposition station is configured to affix the second self-limiting monolayer forming material on a first major surface of the belt.

Embodiment 5

The apparatus of any of embodiments 1-3, wherein the second deposition station is configured to affix the second self-limiting monolayer forming material on a second major surface of the belt.

Embodiment 6

The apparatus of any preceding embodiment, further comprising a third deposition station, the third deposition station comprising a third self-limiting monolayer forming material depositing element for affixing at least a monolayer of a third self-limiting monolayer forming material to the belt.

Embodiment 7

The apparatus of any preceding embodiment, wherein the third deposition station is configured to affix the third self-limiting monolayer-forming material to a first major surface of the belt.

Embodiment 8

The apparatus of any of embodiments 1-6, wherein the third deposition station is configured to affix the third self-limiting monolayer-forming material to a second major surface of the belt.

Embodiment 9

The apparatus of any preceding embodiment, further comprising a fourth deposition station, the fourth deposition station comprising a fourth self-limiting monolayer forming material depositing element for affixing at least a monolayer of a fourth self-limiting monolayer forming material to the belt.

Embodiment 10

The apparatus of any preceding embodiment, wherein the fourth deposition station is configured to affix the fourth self-limiting monolayer-forming material to a first major surface of the belt.

Embodiment 11

The apparatus of any of embodiments 1-9, wherein the fourth deposition station is configured to affix the fourth self-limiting monolayer-forming material to a second major surface of the belt.

Embodiment 12

The apparatus of any preceding embodiment, wherein the first self-limiting monolayer forming material is dissolved or dispersed in a first liquid.

Embodiment 13

The apparatus of any embodiment 12, wherein the first liquid comprises one or more of water, benzene toluene, xylenes, ethers, such as diethyl ether, ethyl acrylate, butyl acrylate, acetone, methyl ethyl ketone, dimethylsulfoxide, dichloromethane, chloroform, turpentine, and hexanes.

Embodiment 14

The apparatus of any of embodiments 2-13, wherein the second self-limiting monolayer forming material is dissolved or dispersed in a second liquid.

Embodiment 15

The apparatus of embodiment 14, wherein the second liquid comprises one or more of water, benzene toluene, xylenes, ethers, such as diethyl ether, ethyl acrylate, butyl acrylate, acetone, methyl ethyl ketone, dimethylsulfoxide, dichloromethane, chloroform, turpentine, and hexanes.

Embodiment 16

The apparatus of any of embodiments 7-15, wherein the third self-limiting monolayer forming material is dissolved or dispersed in a third liquid.

Embodiment 17

The apparatus of any embodiment 16, wherein the third liquid comprises one or more of water, benzene toluene, xylenes, ethers, such as diethyl ether, ethyl acrylate, butyl acrylate, acetone, methyl ethyl ketone, dimethylsulfoxide, dichloromethane, chloroform, turpentine, and hexanes.

Embodiment 18

The apparatus of any of embodiments 9-17, wherein the fourth self-limiting monolayer forming material is dissolved or dispersed in a fourth liquid.

Embodiment 19

The apparatus of embodiment 18, wherein the fourth liquid comprises one or more of water, benzene toluene, xylenes, ethers, such as diethyl ether, ethyl acrylate, butyl acrylate, acetone, methyl ethyl ketone, dimethylsulfoxide, dichloromethane, chloroform, turpentine, and hexanes.

Embodiment 20

The apparatus of any of claims 12-19, further comprising a first recycling element for collecting at least some of the first liquid and returning at least some of the collected first liquid to the first deposition station.

Embodiment 21

The apparatus of any of embodiments 14-20, further comprising a second recycling element for collecting at least some of the second liquid and returning at least some of the collected second liquid to the second deposition station.

Embodiment 22

The apparatus of any of embodiments 16-21, further comprising a third recycling element for collecting at least some of the third liquid and returning at least some of the collected third liquid to the third deposition station.

Embodiment 23

The apparatus of any of embodiments 18-22, further comprising a fourth recycling element for collecting at least some of the fourth liquid and returning at least some of the collected fourth liquid to the fourth deposition station.

Embodiment 24

The apparatus of any preceding embodiment, wherein the first self-limiting monolayer depositing element is a sprayer.

Embodiment 25

The apparatus of any of embodiments 2-24, wherein the second self-limiting monolayer depositing element is a sprayer.

Embodiment 26

The apparatus of any of embodiments 7-25, wherein the third self-limiting monolayer depositing element is a sprayer.

Embodiment 27

The apparatus of any of embodiments 10-25, wherein the fourth self-limiting monolayer depositing element is a sprayer.

Embodiment 28

The apparatus of any preceding embodiment, which does not include a rinsing element.

Embodiment 29

The apparatus of any of the preceding embodiments, wherein the apparatus is capable of affixing a monolayer of cationic material or anionic material to the belt while the belt is moving at a speed of at least 0.25 m/s, 0.25 m/s, at least 0.50 m/s, at least 0.75 m/s, at least 1 m/s, at least 1.25 m/s, or at least 1.5 m/s.

Embodiment 30

The apparatus of any of the preceding embodiments, wherein the apparatus is capable of affixing a monolayer of cationic material or anionic material to the belt while the belt is moving at a speed of at least 0.5 m/s.

Embodiment 31

The apparatus of any of the preceding embodiments, wherein the apparatus is capable of affixing a monolayer of cationic material or anionic material to the belt while the belt is moving at a speed of at least 0.75 m/s.

Embodiment 32

The apparatus of any of the preceding embodiments, wherein the apparatus is capable of affixing a monolayer of cationic material or anionic material to the belt while the belt is moving at a speed of at least 1.0 m/s.

Embodiment 32a

The apparatus of any of the preceding embodiments, wherein the apparatus is capable of affixing a monolayer of cationic material or anionic material to the belt while the belt is moving at a speed of at least 1.5 m/s.

Embodiment 32b

The apparatus of any of the preceding embodiments, wherein the belt is positioned sufficiently parallel to the ground such that the first deposition station can apply a layer of first self-limiting monolayer forming material that has an essentially uniform thickness across the width of the first major surface.

Embodiment 32c

The apparatus of any of the preceding embodiments, wherein the belt is positioned within 5° of parallel to the ground.

Embodiment 33

A method of making a coating on a substrate, the method comprising (a) tensioning a substrate in the form of a belt around a first roller and a second roller such that at least a portion of the belt faces a first deposition station, the first deposition station comprising a first self-limiting monolayer forming material depositing element for affixing a monolayer of a first self-limiting monolayer forming material to the belt, (b) moving the belt around the first roller and the second roller while engaging the first self-limiting monolayer forming material depositing element to apply a first liquid comprising a first self-limiting monolayer forming material on the belt;

(c) engaging a first directional gas curtain producing element that is positioned downstream from the first deposition station to provide a gas curtain that simultaneously meters and dries the first liquid on the belt while leaving at least a monolayer of first self-limiting monolayer forming material on the belt.

Embodiment 34

A method of embodiment 33, wherein the step of applying a first liquid comprising a first self-limiting monolayer forming material on the belt comprises spraying the first liquid on the belt.

Embodiment 35

The method of any of embodiments 33-34, wherein at least a portion of the belt faces a second deposition station that is downstream from the first deposition station, the second deposition station comprising a second self-limiting monolayer forming material depositing element for affixing at least a monolayer of a second self-limiting monolayer forming material to the belt; and wherein the method further comprises the step of (d) engaging the second self-limiting monolayer forming material depositing element to apply a second liquid comprising a second self-limiting monolayer forming material on the belt; and (e) engaging a second directional gas curtain producing element that is positioned downstream from the second deposition station to provide a gas curtain that simultaneously meters and dries the first liquid on the belt while leaving at least a monolayer of first self-limiting monolayer forming material on the belt.

Embodiment 36

The method of any of embodiments 33-35, wherein the step of applying a second liquid comprising a first self-limiting monolayer forming material on the belt comprises spraying the second liquid on the belt.

Embodiment 37

The method of any of embodiments 33-36, wherein the first and second self-limiting monolayer forming materials are complementary materials.

Embodiment 38

The method of embodiment 37, wherein the first self-limiting monolayer forming material is a cationic material.

Embodiment 39

The method of embodiment 37, wherein the second self-limiting monolayer forming material is an anionic material.

Embodiment 40

The method of embodiment 37, wherein the first self-limiting monolayer forming material is an anionic material.

Embodiment 41

The method of embodiment 37, wherein the second self-limiting monolayer forming material is an anionic material.

Embodiment 42

The method of embodiment 38, wherein the first self-limiting monolayer forming material is a hydrogen bond donating material.

Embodiment 43

The method of embodiment 37, wherein the second self-limiting monolayer forming material is a hydrogen bond accepting material.

Embodiment 44

The method of embodiment 37, wherein the first self-limiting monolayer forming material is a hydrogen bond accepting material.

Embodiment 45

The method of embodiment 37, wherein the second self-limiting monolayer forming material is a hydrogen bond donating material.

Embodiment 46

The method of any of embodiments 33-36, wherein the method does not include a rinsing step.

Embodiment 47

The method of any of claims 33-46, wherein the belt does not stop moving until at least one of a pre-determined number of monolayers are deposited, a pre-determined amount of time passes, a pre-determined thickness is achieved, or a pre-determined optical, chemical, or physical property is achieved.

Embodiment 48

The method of any of claims 33-47, wherein the first and second self-limiting monolayer forming material depositing elements are sprayers.

Embodiment 49

The method of any of claims 33-48, wherein the method is a roll-to-roll process.

Embodiment 50

The apparatus of method of any of the preceding embodiments, wherein at least the first directional gas curtain producing element is directed at the belt at an angle of between 80° and 90° to the belt.

Embodiment 51

The apparatus of method of any of the preceding embodiments, wherein at least the first directional gas curtain producing element is directed at the belt at an angle of between 85° and 90° to the belt.

Embodiment 52

The apparatus of method of any of the preceding embodiments, wherein at least the first directional gas curtain producing element is directed at the belt at an angle of 90° to the belt.

Embodiment 53

The apparatus or method of any of embodiments 50-52, wherein each directional gas curtain producing element is directed at the belt at the angle specified in any one of embodiments 31-33.

Embodiment 54

The apparatus or method of any of the preceding embodiments, wherein the gap between the first directional gas curtain producing element and a surface of the belt is no more than 0.8 mm, no more than 0.75 mm, no more than 0.7 mm, no more than 0.65 mm, no more than 0.6 mm, no more than 0.55 mm, or no more than 0.5 mm.

Embodiment 55

The apparatus or method of any of the preceding embodiments, wherein the gap between each directional gas curtain producing element and a surface of the belt is no more than 0.8 mm, no more than 0.75 mm, no more than 0.7 mm, no more than 0.65 mm, no more than 0.6 mm, no more than 0.55 mm, or no more than 0.5 mm.

Embodiment 56

The apparatus or method of any of the preceding embodiments, wherein the flux of air per length that is produced by each directional gas curtain producing element when said element is engaged is, in units of $m^2/s$, no less than 0.02, no less than 0.02, no less than 0.024, no less than 0.025. no less than 0.026, no less than 0.028, or no less than 0.03.

Embodiment 57

The apparatus or method of any of the preceding embodiments, wherein the belt moves at a speed of at least 0.25 m/s, 0.25 m/s, at least 0.50 m/s, at least 0.75 m/s, at least 1 m/s, at least 1.25 m/s, or at least 1.5 m/s.

EXAMPLE SECTION

Materials

Polydiallyl dimethylammonium chloride (PDAC) was used as a 20 mM (based on repeat unit mass) solution in water, had a MW of 100-200K, and was obtained from Sigma Aldrich (St. Louis, Mo., USA).

$TiO_2$ nanoparticles were used as a 10 g/L colloidal dispersion in water, and were obtained from Sigma Aldrich under the trade designation TiMaKs W10.1.

$SiO_2$ nanoparticles were used as a 9.6 g/L colloidal dispersion in water, and were obtained from Sigma Aldrich under the trade designation Ludox AS-40.

Tetramethyl ammonium chloride (TMACl) and tetramethyl ammonium hydroxide (TMAOH) were obtained from Sigma Aldrich.

101.6 micron thick primed polyethylene terephthalate (PET) was obtained from SKC, Inc. (Covington, Ga., USA) under the trade designation SKYROL SH40.

Spray nozzles were obtained from Spraying Systems Co. (Wheaton, Ill. USA) under the trade designation TPU-4001E SS

Experimental Conditions

An apparatus as described in FIG. 1 was used to generate the data described in herein. The operating conditions are described in Table 1. The PDAC was used in a concentration of 20 mM with respect to the repeat unit and the pH was adjusted to 10.0 by addition of TMAOH. The $TiO_2$ was used in a concentration of 10 g/L, admixed with TMACl (final TMACl concentration was 65 mM), and the pH adjusted to 11.5 by addition of TMAOH. The $SiO_2$ was used in a concentration of 9.6 g/L admixed with TMACl (final TMACl concentration was 48 mM), and the pH was adjusted to 11.5 by addition of TMAOH.

Thickness measurements were conducted using a Filmetics F10AR reflectometer. Samples for measurement were taken from a portion of the belt downstream of the second deposition station (which in these Examples deposited anionic materials) and upstream of the first deposition station (which in these Examples deposited cationic materials) in order to ensure that the samples had the same number of cation and anion layers.

TABLE 1

| | |
|---|---|
| Substrate (belt) | 101.6 micron primed PET |
| Cation | PDAC |
| Cation line pressure | 317 kPa |
| Cation flow rate | 10.5 $cm^3$/sec |
| Cation air knife pressure | 276 kPa |
| Cation air knife gap to roller | 0.635 mm |
| Cation air knife angle* | 23 degrees |
| Cation air knife opening | 101.6 micron |
| Anion | $TiO_2$ or $SiO_2$ |
| Anon line pressure | 227 kPa for $TiO_2$, 241 kPa for $SiO_2$ |
| Anion flow rate | 4.2 $cm^3$/min for $TiO_2$, 7.9 $cm^3$/min for $SiO_2$ |

TABLE 1-continued

| | |
|---|---|
| Anion air knife pressure | 276 kPa |
| Anion air knife gap to roller | 0.635 mm |
| Anion air knife angle* | 23 degrees |
| Anion air knife opening | 101.6 micron |
| Belt linear velocity | 0.254 m/s |

*This refers to the air knife angle with respect to the ground. All air knives were positioned perpendicular to the roller.

Example 1

Ten bilayers were coated on a belt, and the excess sprayed materials were collected in the recycling elements. The belt was removed, and a new belt tensioned around the apparatus. The collected excess materials were coated on the new belt, for a total of six bilayers. The collected excess was collected and recycled one or more times, and further deposited. The average thickness of each layer in the resulting coatings is shown in Table 2. In that table, 0 times recycled refers to a fresh batch of coating materials, 1 times recycled refers to the materials recycled from the fresh batch, 2 times recycled refers to the materials recycled from the 1 times recycled batch, etc.

TABLE 2

| Bilayer Content | Number of times Recycled | Thickness per Bilayer (nm) | Std. Deviation (nm) |
|---|---|---|---|
| PDAC/$TiO_2$ | 0 | 7.74 | 0.05 |
| PDAC/$TiO_2$ | 1 | 7.93 | 0.16 |
| PDAC/$SiO_2$ | 0 | 21.3 | 0.45 |
| PDAC/$SiO_2$ | 1 | 21.2 | 0.46 |
| PDAC/$SiO_2$ | 4 | 22.1 | 0.62 |

Examples 2-25

A SKYROL belt was tensioned between two rollers. A sprayer was set up to spray liquid onto the belt upstream of the first roller. A directional gas curtain producing element was placed perpendicular to the first roller. At the beginning of each experiment, the belt was moved at the indicated speed, and the water sprayer was turned on with a specified water flow. The distance between the air knife and the roller, the angle of the gas produced by the directional gas curtain producing element with respect to the ground, and the flow of air through the directional gas curtain producing element were varied in each experiment order to determine the conditions that successfully produce a dry belt downstream from the directional air curtain producing element. Dryness was determined by touching a piece of latex to the moving web; a wet web leaves a mark on the latex whereas a dry web does not. The distance to dry is the distance downstream of the air knife at which the belt was dry. The second roller was 43.2 cm downstream of the directional gas curtain producing element. Thus, a distance to dry of none means that the web was still wet when it reached the second roller. A distance to dry of 0 indicates that the web was at the earliest point downstream of the directional gas curtain producing element that a measurement could be taken.

The results of these experiments are tabulated in Table 3. In Table 3, flux per length is the total flux of air through the directional gas curtain producing element divided by the length of the gas curtain produced by the element. Angle is the angle of the gas curtain with respect to the ground; the gas curtain is perpendicular to the belt in all cases. Water flow is the flux of water sprayed on the belt upstream of the first roller. Gap to belt is the distance between the opening of the directional gas curtain producing element and the wet surface of the belt. Distance to dry is defined above.

TABLE 3

| Ex. No. | Gap to belt (μm) | Flux per Length ($m^2/s$) | Angle (degrees) | Belt Speed (m/s) | Water Flow ($cm^3/s$) | Distance to dry (cm) |
|---|---|---|---|---|---|---|
| 2 | 533 | 0.0427 | 45 | 0.254 | 11.6 | 10.2 |
| 3 | 533 | 0.0427 | 45 | 0.381 | 11.6 | 38.1 |
| 4 | 533 | 0.0427 | 45 | 0.127 | 11.6 | 0 |
| 5 | 533 | 0.0345 | 45 | 0.254 | 11.6 | 22.9 |
| 6 | 533 | 0.0407 | 45 | 0.254 | 11.6 | 17.8 |
| 7 | 533 | 0.0286 | 45 | 0.254 | 11.6 | 43.2 |
| 8 | 406 | 0.0427 | 45 | 0.254 | 11.6 | 0 |
| 9 | 406 | 0.0427 | 45 | 0.381 | 11.6 | 0 |
| 10 | 406 | 0.0427 | 45 | 0.508 | 11.6 | 2.54 |
| 11 | 406 | 0.0427 | 60 | 0.254 | 11.6 | 0 |
| 12 | 533 | 0.0427 | 60 | 0.254 | 11.6 | 43.2 |
| 13 | 660 | 0.0427 | 10 | 0.254 | 11.6 | 5.08 |
| 14 | 533 | 0.0427 | 10 | 0.254 | 11.6 | 5.08 |
| 15 | 914 | 0.0427 | 10 | 0.254 | 11.6 | 7.62 |
| 16 | 533 | 0.0427 | 30 | 0.254 | 11.6 | 12.7 |
| 17 | 533 | 0.0427 | 30 | 0.254 | 6.31 | 10.2 |
| 18 | 533 | 0.0427 | 25 | 0.254 | 11.6 | 0 |
| 19 | 533 | 0.0427 | 35 | 0.254 | 11.6 | 15.2 |
| 20 | 533 | 0.0359 | 30 | 0.254 | 11.6 | 2.54 |
| 21 | 406 | 0.0359 | 30 | 0.254 | 11.6 | 0 |
| 22 | 533 | 0.019 | 30 | 0.254 | 11.6 | 43.2 |
| 22 | 533 | 0.0264 | 30 | 0.254 | 11.6 | 43.2 |
| 24 | 533 | 0.0328 | 30 | 0.254 | 11.6 | 12.7 |
| 25 | 533 | 0.0328 | 30 | 0.127 | 11.6 | 2.54 |

What is claimed is:

1. An apparatus comprising a first roller for moving a belt;

a second roller for moving a belt;

a belt having tensioned around the first roller and the second roller;

a first deposition station positioned to face the belt, the first deposition station comprising a first self-limiting monolayer forming material depositing element to deposit a first liquid comprising a first self-limiting monolayer forming material on the belt for affixing a monolayer of the first self-limiting monolayer forming material to the belt;

a first directional gas curtain producing element positioned downstream from the first deposition station to provide a gas curtain blowing the belt, the first directional gas curtain element being configured and arranged to provide a gas curtain that simultaneously meters and dries the first liquid on the belt while leaving at least a monolayer of the first self-limiting monolayer forming material on the belt; and wherein the apparatus does not include a rinsing element to remove excess first liquid from the belt;

a second deposition station located downstream of the first directional gas curtain producing element, the second deposition station comprising a second self-limiting monolayer forming material depositing element to deposit a second liquid comprising a first self-limiting monolayer forming material for affixing a monolayer of the second self-limiting monolayer forming material to the belt; and a second directional gas curtain producing element a positioned downstream from the second deposition station to provide a gas curtain blowing on the belt.

2. The apparatus of claim 1, further comprising a first recycling element for collecting at least some of the first liquid and returning at least some of the collected first liquid to the first deposition station.

3. The apparatus of claim 2, further comprising a second recycling element for collecting at least some of the second liquid and returning at least some of the collected second liquid to the second deposition station.

4. The apparatus of claim 1, wherein at least one of the first self-limiting monolayer forming material depositing element and the second self-limiting monolayer forming material depositing element is a sprayer.

5. The apparatus of claim 1, wherein the apparatus is capable of affixing a monolayer of cationic material or anionic material to the belt while the belt is moving at a speed of at least 0.25 m/s.

6. The apparatus of claim 1, wherein at least one of first self-limiting monolayer forming material depositing element and the second self-limiting monolayer forming material depositing element is a sprayer.

7. The apparatus of claim 1, wherein the directional gas curtain producing element is directed at the belt at an angle of between 80° and 90° to the belt.

8. The apparatus of claim 1, wherein the belt is an endless belt.

* * * * *